US005261574A

United States Patent [19]

Jouillat et al.

[11] Patent Number: 5,261,574

[45] Date of Patent: Nov. 16, 1993

[54] CLOSABLE AND FLOW RATE ADJUSTING PUSHBUTTON FOR A HAND-HELD FLUID SPRAY OR DISPENSER DEVICE

[75] Inventors: Claude Jouillat, Montigny-sur-Avre; Michel Brunet, Sainte-Colombe-La-Commanderie, both of France

[73] Assignee: Societe Technique de Pulverisation S.T.E.P., Verneuil-sur-Avre, France

[21] Appl. No.: 834,398

[22] Filed: Feb. 12, 1992

[30] Foreign Application Priority Data

Feb. 13, 1991 [FR] France ..... 91-01653

[51] Int. Cl.[5] ..... B65D 83/44

[52] U.S. Cl. ..... 222/402.1; 222/402.17; 222/505; 222/515; 222/516

[58] Field of Search ..... 239/476, 479, 482–485, 239/579, 581.1, 581.2, 582.1, 583; 222/41, 47, 48, 394, 402.1, 402.12, 402.17, 512, 515, 516, 518, 505

[56] References Cited

U.S. PATENT DOCUMENTS

| | | | |
|---|---|---|---|
| 1,794,555 | 3/1931 | Sjoman et al. | 239/485 |
| 3,093,318 | 6/1963 | Chow | 239/582.1 X |
| 3,170,606 | 2/1965 | Boyer | 222/402.17 X |
| 3,250,474 | 5/1966 | McKernan | 222/402.12 X |
| 3,361,301 | 1/1968 | Meshberg | 222/402.12 X |
| 3,471,092 | 10/1969 | Hickey | 222/402.1 X |
| 3,638,867 | 2/1972 | Venus, Jr. | 222/402.17 X |
| 3,703,994 | 11/1972 | Nigro | 222/402.17 X |
| 3,804,296 | 4/1974 | Webster | 222/48 |
| 3,961,756 | 6/1976 | Martini | 239/485 X |
| 4,989,790 | 2/1991 | Martin et al. | 239/483 |

FOREIGN PATENT DOCUMENTS

| | | | |
|---|---|---|---|
| 7821387 | of 1978 | Fed. Rep. of Germany . | |
| 2182546 | of 1973 | France . | |
| 5919996 | of 1977 | France . | |
| 550493 | 10/1956 | Italy | 239/483 |
| 92/007660 | 5/1992 | World Int. Prop. O. | 239/485 |

*Primary Examiner*—Kevin P. Shaver

*Attorney, Agent, or Firm*—Sughrue, Mion, Zinn, Macpeak and Seas

[57] ABSTRACT

A pushbutton for actuating a device for dispensing or spraying a fluid substance includes a hollow body 1 having an outlet end 2 in which an outlet orifice 3 is formed, the outlet end including an inside surface 2*a* which is not perpendicular to the axis 1*a* of the body. An adjustment member 10 is rotatably received in the body of the pushbutton, and includes a shutter 19 provided with a front surface 19*a* that is complementary in shape to the inside surface of the outlet end. The shutter is urged towards the outlet end by a resilient tongue 18. The rotation of the adjustment member and shutter varies the outlet flow rate from the pushbutton.

19 Claims, 4 Drawing Sheets

FIG.5
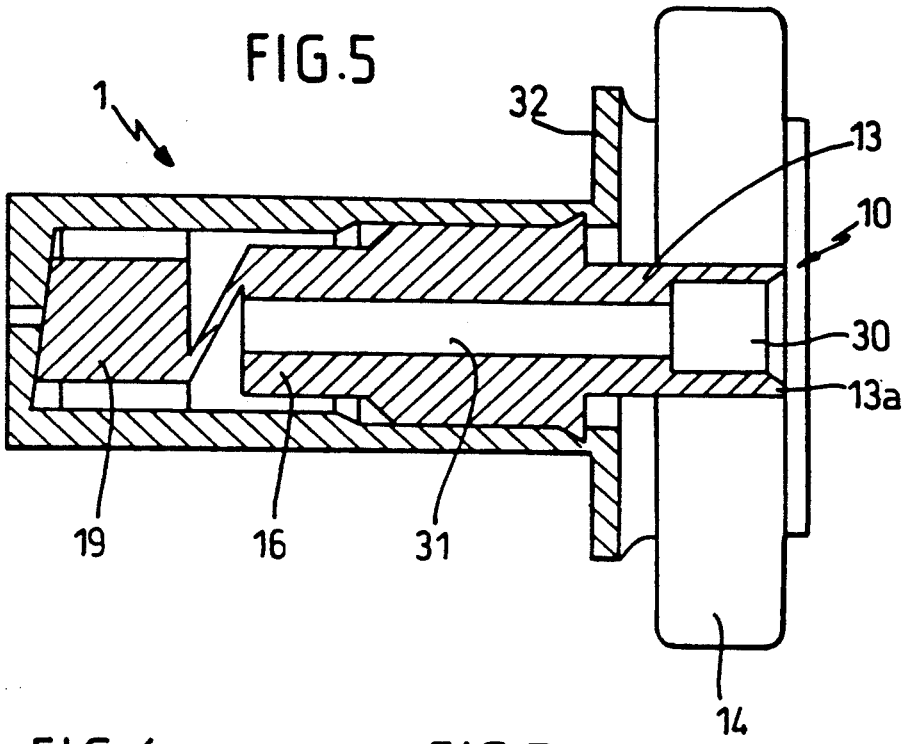
FIG.6
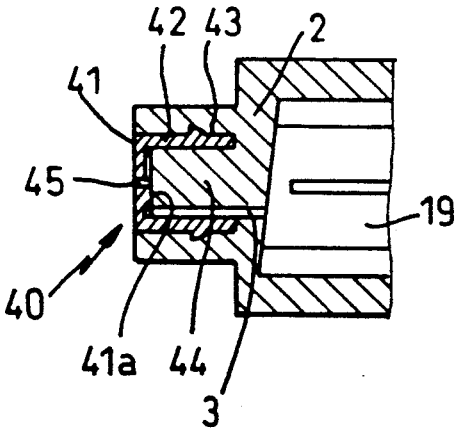
FIG.7
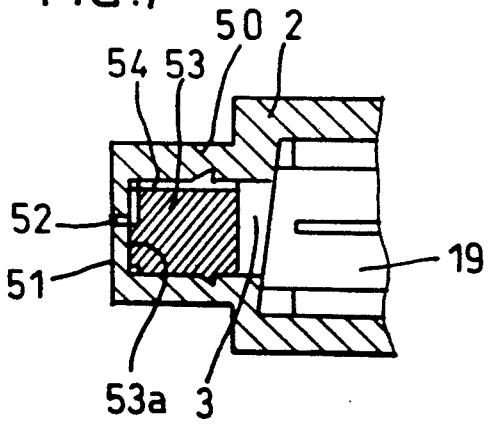
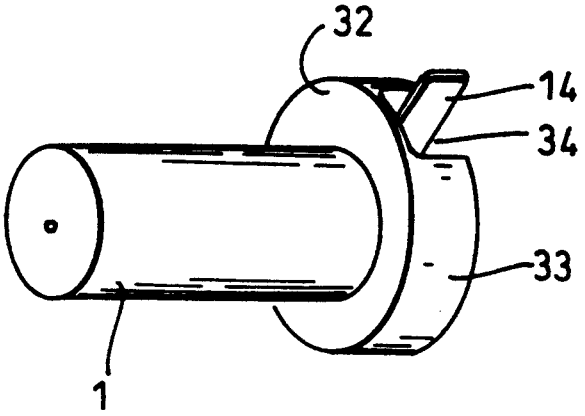
FIG.5a

CLOSABLE AND FLOW RATE ADJUSTING PUSHBUTTON FOR A HAND-HELD FLUID SPRAY OR DISPENSER DEVICE

The present invention relates to a closable and flow rate adjusting pushbutton for a hand-held fluid spray or dispenser device. More particularly, the pushbutton of the invention is intended to be fitted to a metering pump or to a propellant gas device for spraying or dispensing substances such as perfume, pharmaceuticals, cosmetics, or the like.

BACKGROUND OF THE INVENTION

Such devices are said to be "hand-held" in that they can be held in the hand: they are generally actuated by pressing a finger on the pushbutton, but they may be actuated by mechanical means or electromechanical means. Such devices are generally discarded after their supply of substance has been used up, and as a result they must be cheap.

There exists a large number of pushbuttons in the state of the art suitable for actuating a spray or a dispenser, which buttons fit onto an outlet tube of a spray or a dispenser and include an outlet orifice for the substance. Such pushbuttons are generally of fixed shape such that the rate at which substance flows through them depends solely on the pressure of said substance in the outlet tube of the spray or dispenser. Thus, a user cannot adjust the outlet flow rate of the substance as desired so that the substance is delivered drop by drop or on the contrary in the form of a powerful jet.

This function of being able to adjust the outlet flow rate of the substance is particularly necessary for devices using nitrogen as a propellant. It is known that, unlike freons, nitrogen under ordinary pressures does not liquefy to mix with the substance contained in the supply in the device: nitrogen pressure is thus high when the receptacle is nearly full of substance, and then the nitrogen expands as the substance is consumed so the nitrogen pressure falls off. When using a conventional pushbutton of fixed shape on such a device having nitrogen as its propellant, the delivery flow rate of the substance is thus high when the receptacle of substance is full, and this flow rate drops off as the pressure of the nitrogen itself drops off as the substance is consumed. There is thus a danger of the flow rate of the substance being too high initially and/or too low when the receptacle of substance is nearly empty.

It is therefore clearly desirable to provide a pushbutton enabling a user to adjust the outlet flow rate of the substance to that which may be required the purpose of the adjustment may either be to vary the flow rate of the substance or else on the contrary it may be to maintain it within a range of acceptable values, as described above. Such an improvement should be achieved without significantly increasing the cost of the pushbutton relative to a conventional pushbutton of fixed shape.

It is also useful to be able to close the outlet orifice of a pushbutton while it is not in use to prevent the substance contained in the pushbutton drying out, to prevent it oxidizing, or to prevent it being polluted on contact with the air.

SUMMARY OF THE INVENTION

The present invention therefore provides a pushbutton for actuating a spray or dispenser device for spraying or dispensing a fluid substance, said device having an outlet tube, said pushbutton being capable of fitting onto the outlet tube of said spray or dispenser device and including an outlet orifice for the substance, wherein the pushbutton comprises:

a hollow body adapted to communicate with said outlet tube via an inlet orifice, said hollow body having a side wall whole inside shape has an axis of revolution, said hollow body having an outlet end in which the outlet orifice is formed, the said outlet end including an inside surface which does not constitute a body of revolution about said axis;

an adjustment member rotatably received in the body of the pushbutton, the said adjustment member including a shutter provided with a front surface that is complementary in shape to the inside surface of the outlet end, the said front surface of the shutter facing said inside surface of the outlet end, said shutter being urged towards said inside surface of the outlet end by resilient means, said shutter including an axial passage putting the inside surface of the outlet end into communication with the inlet orifice, and said axial passage not being disposed to coincide permanently with the outlet orifice; and drive means for the adjustment member enabling the outlet flow rate from the pushbutton to be varied by rotating the adjustment member by acting on said drive means.

Advantageously, the front surface of the shutter is adapted to bear in sealed manner against the inside surface of the outlet end of the body so as to enable the outlet orifice to be fully closed.

The said resilient means may be installed between the shutter and a portion of said adjustment member that is held axially in said body. Said resilient means may be a resilient flexible tongue integrally formed with the shutter and said portion of said adjustment member that is held axially in said body.

Advantageously, said portion of said adjustment member that is held axially in said body is extended towards the outside of the body of the pushbutton by a drive rod provided with grip means to enable said rod to be rotated. Said grip means may be constituted by at least one lug extending from the drive rod of the adjustment member. The body of the pushbutton may include abutment means limiting the rotary movement of the grip means and defining two abutment positions of said grip means corresponding respectively to an open angular position and to a closed angular position of the adjustment member. Said abutment means may be a portion of a thrust member enabling the pushbutton to be actuated.

Advantageously, the inside surface at the outlet end of the body is a plane face that is not perpendicular to the axis of revolution of said side wall of the body. The shutter may possess a conical portion adapted to bear in sealed material in a complementary conical portion formed around the outlet orifice of the pushbutton in the inside surface at the outlet end of the pushbutton body.

Advantageously, the adjustment member is held angularly about the axis of revolution by being a snug fit against the body: the adjustment member thus moves angularly only under the action of the drive means.

In another embodiment, the pushbutton may further include:

a thrust piece overlying the body of the pushbutton and presenting at least one moving portion that moves substantially parallel to the outlet tube of the spray or dispenser device;

mechanical link means linking said moving portion of the thrust piece and said drive means for driving the adjustment member, enabling said drive means to be moved during displacement of said thrust piece;

resilient return means for the thrust piece urging said thrust piece so as to move its moving portion away from the body of the pushbutton; and abutment means limiting the displacement of the moving portion of the thrust piece in the thrust direction of the resilient return means of the thrust piece, said abutment means thus defining a rest position for the thrust piece and for the adjustment member, in which position the shutter closes the outlet orifice.

In a particular example of the above embodiment, the pushbutton is further characterized in that:

the drive means of the adjustment member include a drive lever projecting beyond the body;

the link means are constituted by a tongue hinged to said drive lever and linked to the moving portion of the thrust piece; and the moving portion of the thrust piece constitutes a first lateral extremity of said thrust piece, and said thrust piece includes an opposite second lateral extremity of its moving portion, said second lateral extremity being hinged on the body.

Advantageously, the hinge of said second lateral extremity of the thrust piece on the body provides said second lateral extremity with a degree of clearance enabling it to move towards the first lateral extremity and also in the opposite direction. Said second lateral extremity of the thrust piece may include a bead snapped into a housing of the body. Advantageously, said tongue is made of plastic integrally with the drive lever and the thrust piece. Advantageously, the thrust piece is made of plastic and the resilient return means of the thrust piece is constituted by a blade of plastic formed integrally with the thrust piece. Said tongue may be connected to the thrust piece via a hinge.

BRIEF DESCRIPTION OF THE DRAWINGS

Embodiments of the invention are described by way of example with reference to the accompanying drawings, in which:

FIG. 5 is a section view through another embodiment of a pushbutton of the invention;

FIG. 5*a* is a perspective view of the FIG. 5 pushbutton;

FIG. 6 is a fragmentary section view of a pushbutton of the invention provided with a conventional spray nozzle;

FIG. 7 is a fragmentary section view of a pushbutton of the invention provided with an internal spray nozzle;

DETAILED DESCRIPTION

Figure 1:
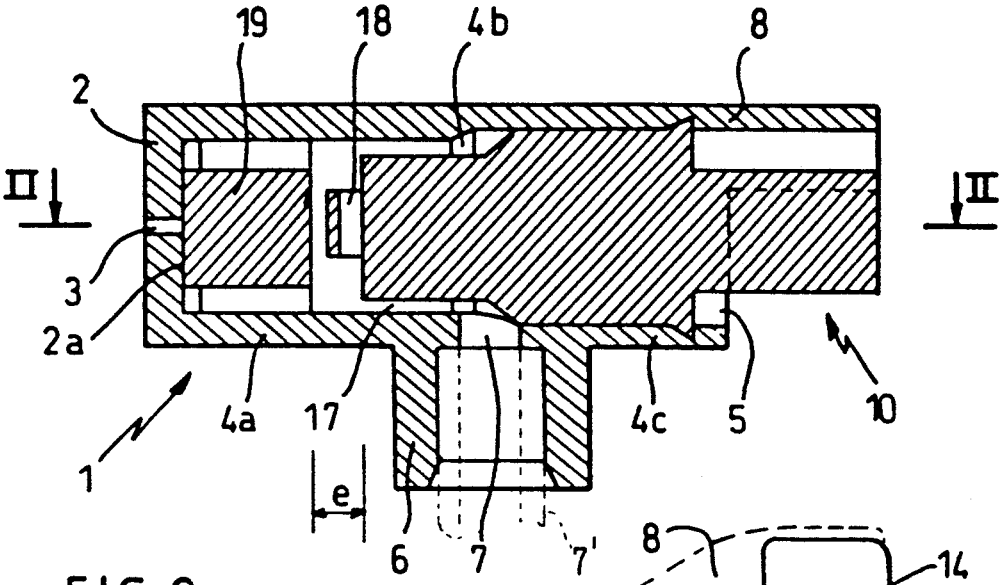
FIG. 1 is a view of a first embodiment of a pushbutton of the invention shown in its closed position, and in section on line I—I of FIG. 2.
Figure 2:
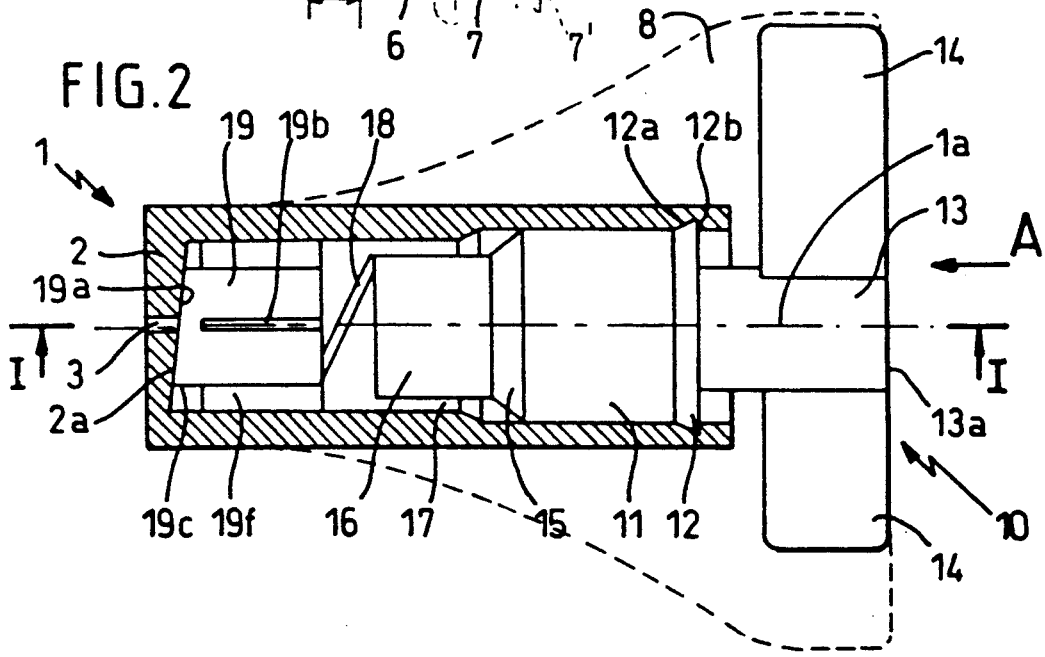
FIG. 2 is a fragmentary section on line II—II of the FIG. 1 pushbutton.
Figure 3:
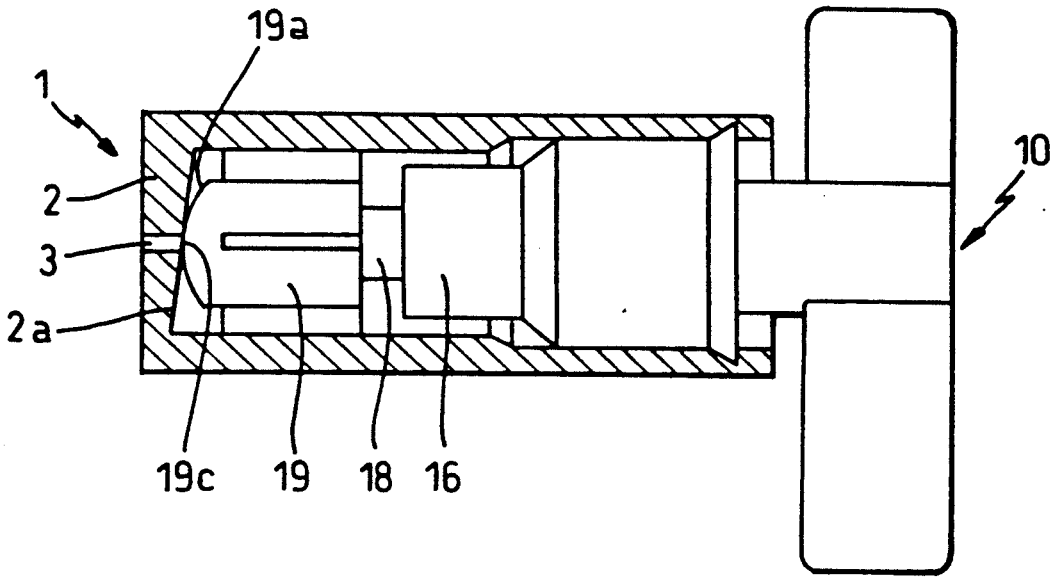
FIG. 3 is a fragmentary section of the pushbutton of FIG. 2 in the open position.

First embodiment (FIGS. 1 to 3)

With reference to FIG. 1, the pushbutton of the invention may comprise a hollow body 1 of substantially cylindrical inside shape rotatably receiving an adjustment member 10 which is advantageously a snug fit therein. These two parts may be made of molded plastic.

The body 1 has an outlet end 2 provided with a substantially central outlet orifice 3. Starting from the outlet end 2, a cylindrical wall 4*a* of small inside diameter extends to a frustoconical inside flare 4*b*. Beyond the flare 4*b* a second cylindrical wall 4*c* extends to an open end 5. This disposition of the body 1 in the form of two portions of different inside diameters is advantageous during assembly of the pushbutton as described below; however the body 1 could have the same inside diameter along its entire length without going beyond the ambit of the present invention. As shown in FIG. 2, the side walls 4*a*, 4*b*, and 4*c* of the body 1 of the pushbutton have an axis of revolution 1*a*. The outlet end 2 includes an inside face 2*a* which is planar but not perpendicular to the axis 1*a*. More generally, the inside face 2*a* is therefore not part of a body of revolution about the axis 1*a*.

In this particular embodiment, the pushbutton is mounted on an outlet tube 7' of a pump or a valve by means of a tubular wall 6 (===FIG. 1) which projects from the cylindrical body 1 of the pushbutton perpendicularly to the axis 1*a* of the body 1 and which engages over said outlet tube. A radial orifice 7 formed through the cylindrical body 1 of the pushbutton puts the inside of the body 1 into communication with the inside of the tubular wall 6 so as to enable substance to penetrate into the body 1 from the outlet tube 7' when the device is actuated. In addition, the body 1 is provided with a planar thrust member 8 (see FIGS. 2 and 2*a*) enabling the pushbutton to be actuated by user finger pressure This thrust member 8 may extend from the outlet end 2 of the body 1 to beyond the open end 5 of the body 1. Advantageously, for reasons that are explained below, and as shown in dashed lines in FIG. 2, the width of the thrust member 8 is greater than that of the body 1, at least where it extends beyond the open end 5 of said body 1.

As can be seen in FIG. 2, the adjustment member 10 comprises a solid cylindrical plug 11 whose diameter is equal to the inside diameter of the cylindrical wall 4*c* so as to come into sealed contact with said cylindrical wall 4*c* of the body 1. The plug is rotatably mounted inside the body 1, but it is secured axially by snap-fastening means such as a peripheral rib 12 on the plug 11 snapping into a complementary groove inside the cylindrical wall 4*c*. Advantageously, the peripheral rib 12 is in the form of a frustoconical flare 12*a* terminated by a radial annular face 12*b* directed towards the open end 5 of the body of the pushbutton: this facilitates assembling the plug 11 inside the body 1, and when pressure is established inside the body 1, the snap-fastening provides better resistance to the pressure which tends to push the plug 11 back out through the open end 5 of the body 1. The plug 11 may optionally be extended towards the open end 5 of the body 1 by a drive rod 13. The rod 13 extends to an outside end 13*a* situated beyond the open end 5. The end 13*a* includes two lugs 14 which enable a user to rotate the rod 13. In this particular example, the lugs 14 are at an angle $\alpha$ of 135° to each other. The thrust member 8 which extends over the rod 13 and the lugs 14 constitutes an abutment for the lugs 14. In this particular example, the thrust member 8 has a bottom abutment surface 8a which engages it 14 when said lug is substantially perpendicular to the tubular wall 6, such that the rod 13 is capable of rotating substantially through 45°. The angle $\alpha$ between the two lugs may be other than 135°: in the general case, the rod 13 can be rotated through an angle of $(180-\alpha)°$. Optionally, the rod 13 could have one lug 14 only, in which case the rod 13 could be rotated through substantially 180°.

The plug 11 is also extended towards the outlet end 2 of the body 1 by a frustoconical taper 15 followed by a smaller diameter cylindrical portion 16 so as to leave an annular passage 17 free between the walls 4a, 4b, and 4c of the body of the pushbutton and the frustoconical taper 15 and the cylindrical portion 16 of the adjustment member 10. The plug is axially positioned so that the radial orifice 7 opens out into the annular passage 17.

The smaller diameter cylindrical portion 16 is extended towards the outlet end 2 by a fine flexible and resilient tongue 18 which extends between the cylindrical portion 16 and a cylindrical shutter 19, urging the shutter 19 towards the outlet end 2. In this particular example, the tongue 18 extends from a peripheral portion of the cylindrical portion 16 to a diametrically opposite periperal portion of the shutter 19. The tongue 18 could be of any shape or disposition other than that shown in the drawings without going beyond the ambit of the present invention, providing it constitutes a flexible and resilient portion interconnecting the cylindrical portion 16 and the shutter 19, and whose deformation urges the shutter 19 towards the outlet end 2. The tongue 18 thus makes it possible to maintain a gap e (see FIG. 1) between the cylindrical portion 16 and the shutter 19.

The shutter 19 has a front face 19a which is complementary in shape to the face 2a of the outlet end 2. In addition, the shutter 19 has longitudinal outside ribs 19b in contact with the cylindrical wall 4a, thereby centering the shutter 19 relative to the axis 1a of the cylindrical body 1, while leaving passages 19f around the shutter 19. In a variant, the shutter 19 could be of substantially the same diameter as the inside diameter of the cylindrical wall 4a, in which case it should include longitudinal grooves providing passages 19f between the cylindrical wall 4a and said shutter 19.

This shows the advantage of forming the body 1 as two portions of different diameters: when assembling the adjustment member 10 inside the body 1 by engagement and snap-fastening, the shutter 19 is initially inserted without difficulty inside the wall 4c of the body 1 whose inside diameter is greater than the diameter of the shutter 19 plus its ribs; thereafter the shutter 19 reaches the frustoconical inside flare 4b which guides the shutter 19 into the cylindrical wall 4a; and finally the frustoconical taper 15 of the plug 11 comes up to the open end 5 of the body 1 and guides the plug 11 into the cylindrical wall 4c. This thus facilitates assembling the adjustment member 10 inside the body 1. In addition, it should be observed that manufacturing tolerances relating to the length of the body 1 are compensated by the tongue 11 being deformed to a greater or lesser extent, thereby further improving assembly conditions.

Figure 2A:
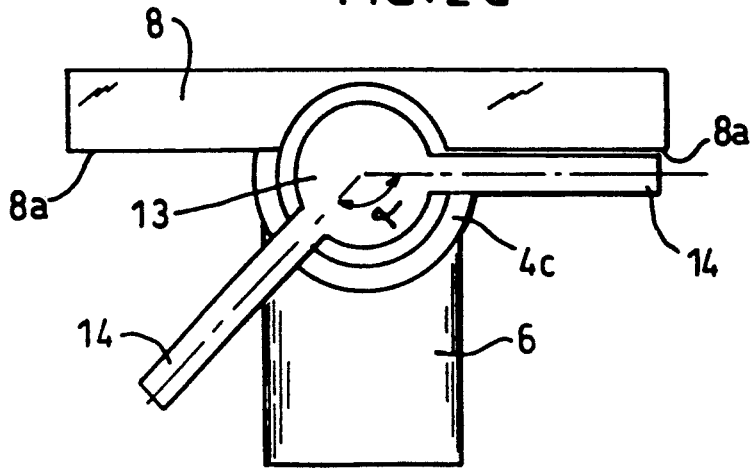
FIG. 2*a* is a view of the pushbutton as seen along direction A in FIG. 2.

When the adjustment member 10 is in an angular position such that the face 19a of the shutter is parallel to the face 2a of the outlet end 2, as shown in FIG. 2, the face 19a under urging from the resilient tongue 18 is resiliently pressed into sealing contact against the face 2a. The pushbutton is thus in a closed position enabling any substance for dispensing that is contained inside the pushbutton to be isolated from the air while the device is not in use. The pushbutton is closed as close as possible to the outlet orifice 3, such that the volume of substance that is nevertheless exposed to air corresponds merely to the inside volume of the outlet orifice 3, which is negligible: for example, for an outlet orifice 3 having a diameter of 0.2 mm and pierced through an end wall 2 having a thickness of 0.3 mm, the volume of the orifice 3 is less than 0.01 $mm^3$. This prevents the substance contained in the pushbutton being spoiled if it is sensitive to air, or being polluted, or being dried out in which case it could block the pushbutton. In addition, this possibility of fully closing the pushbutton provides a safety feature preventing substance being emitted in the event of the device being actuated involuntarily. In this position, one of the lugs 14 is in abutment against the thrust member 8 as shown in FIG. 2a. The user therefore has no difficulty in placing the adjustment member 10 in its closed position.

Starting from this position, if the adjustment member 10 is turned a little using the lugs 14, the face 19a of the shutter 19 is no longer parallel to the face 2a , and as a result only a portion 19c of the shutter furthest from the tongue 18 remains in contact with the face 2a: a wedge-shaped space is thus established between the faces 19a and 2a and the shutter 19 moves towards the cylindrical portion 16. This enables substance to escape via the orifice 3 at a low flow rate when the device is actuated.

If the adjustment member 10 continues to be rotated in the same direction, the wedge-shaped space between the face 2a and he face 19a becomes larger and the shutter 19 continues to move towards the cylindrical portion 16 until the adjustment member has rotated through $(180-\alpha)°$ and one of its lugs 14 is again in abutment against the thrust member 8: the pushbutton is in its maximum flow rate position FIG. 3 shows this position for an angle $\alpha=135°$.

In practice, observation on prototypes has shown that the angle $\beta$ between the face 2a and the axis 1a of the body 1 may be fairly close to 90°: in the cases that have been observed, an axial displacement of the shutter through 0.15 mm to 0.2 mm suffices to vary the outlet flow rate from the pushbutton between 0 and the maximum flow rate. Under such circumstances, the gap e between the cylindrical portion 16 and the shutter may lie in the range 0.2 mm to 0.5 mm when the shutter is in its closed position. These dimensions may naturally be varied without going beyond the ambit of the present invention.

Finally, it may be observed that the pushbutton described includes only two parts made of molded plastic which parts are easy to assemble. The pushbutton is therefore very cheap.

Figure 4:
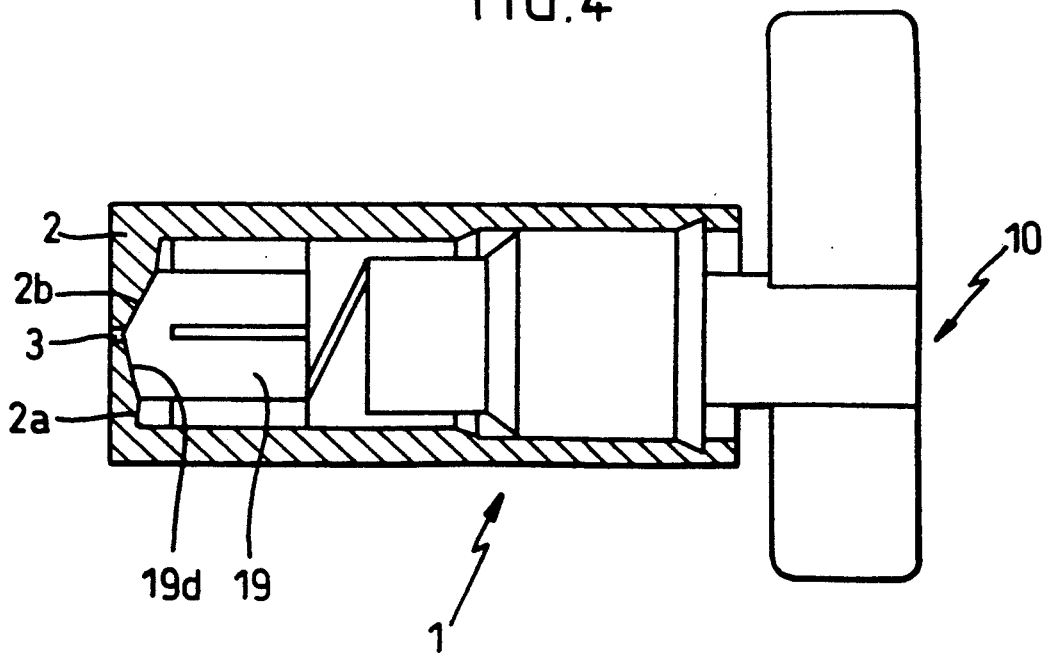
FIG. 4 is a fragmentary section of another embodiment of a pushbutton of the invention.

Second embodiment (FIG. 4)

With reference to FIG. 4, in order to further improve the sealing of the pushbutton when closed by the shutter 19, the face 19a of the pushbutton may be replaced by a portion of a cone 19d having an axis of revolution which is perpendicular to the inside face 2a of the outlet end 2, i.e. not parallel to the axis 1a. Under such circumstances, a conical recess 2b complementary to the conical portion 19d is formed in the inside face 2a so that the conical portion 19d is pressed in sealed manner against the recess 2*d* when the adjustment member 10 is in its closed position. When the adjustment member 10 is rotated from this position, a passage is released between the shutter 19 and the inside face 2*a* in the same manner as above, such that the substance can escape via the orifice 3 at a flow rate that depends on the angular position of the adjustment member 10 within the body 1.

In a variant, the face 19*a* of the shutter 19 that faces the face 2*a* may continue to be generally planar, but with a conical portion 19*d* formed in the middle thereof. Under such circumstances, the conical portion 19*d* may have its axis parallel to the axis 1*a*, providing the face 19*a* does not constitute a body of revolution about the axis 1*a*.

Third embodiment (FIGS. 5 and 5*a*)

With reference to FIGS. 5 and 5*a*, the pushbutton need not be mounted on the push rod of a pump or of a valve perpendicularly to the outlet tube 7' of the pump or of the valve as described in the preceding examples, but it may extend the outlet tube. Under such circumstances, the body 1 of the pushbutton no longer includes a radial orifice 7, nor does it include a radial tubular wall 6, however the rod 13 may include a well 30 opening out to the end 13*a* of the rod, and in which the outlet tube can be engaged. The well 30 is in communication with a longitudinal channel 31 formed through the adjustment member 10 and opening out between the shutter 19 and the cylindrical portion 16. The thrust member 8 is replaced by a thrust ring 32 projecting radially outwards from the body 1 and extended axially beyond the end 13*a* of the rod 13 by a skirt 33 which surrounds the rod 13. The skirt may include two notches 34 receiving two radial lugs 14 disposed at 180° from each other and projecting from the rod 13. The skirt 13 then serves as an abutment for lugs 14 and defines the open and closed angular positions of the rod 13.

Variant with spray nozzle (FIGS. 6 and 7)

The embodiments described above relate essentially to a pushbutton for dispensing a substance without spraying it, even though spraying would be possible by reducing the size of the passages 19*f* and by providing an inside surface 2*a* at the outlet end which slopes relative to the axis 1*a* at an angle $\beta$ that differs little from 90° (for a plane surface 2*a*). If it is desired that the substance should be sprayed, then the outlet end 2 of the pushbutton may be provided with a spray nozzle of the kind well known in the art.

As shown in FIG. 6, the spray nozzle may be external and may have the form of a socket 40 comprising an end wall 41 and a skirt 42. The skirt 42 is conventionally snap-fastened in an annular housing 43 at the outlet end 2 and complementary in shape to the skirt, an inside face 41*a* of the end wall 41 of the spray nozzle coming into abutment against a solid core 44 at the outlet end 2. The end wall 41 includes a central orifice 45 and has one or more generally non-radial grooves extending over its inside face 41*a* from the central orifice 45 to the periphery of the inside face 41*a*. The non-radial grooves communicate with the above-described outlet orifice 3, optionally via an annular groove.

As shown in FIG. 7, the spray nozzle may alternatively be internal as described in detail in European patent No 0 131 501. In that case, the above-described outlet orifice 3 is fairly wide and is extended by a tubular duct 50 which is closed by a front wall 51 pierced by a small diameter central orifice 52. An internal nozzle 53 is installed inside the tubular duct 50, e.g. by snap-fastening or as a force fit, the internal nozzle 53 being complementary in shape to the tubular duct 50. The internal nozzle 53 has a front face 53*a* that comes into abutment against the front wall 51. The front face 53*a*, or the front wall 51, generally includes one or more non-radial grooves that extend from the central orifice 52 to an annular groove formed at the periphery of the front face 53*a*. The annular groove is in communication with a longitudinal groove 54 of the internal nozzle 53 which is itself in communication with the outlet orifice 3. Optionally, each non-radial groove of the front face 53*a* may communicate directly with the longitudinal groove 54 of the nozzle, without going through an annular groove.

Figure 8:
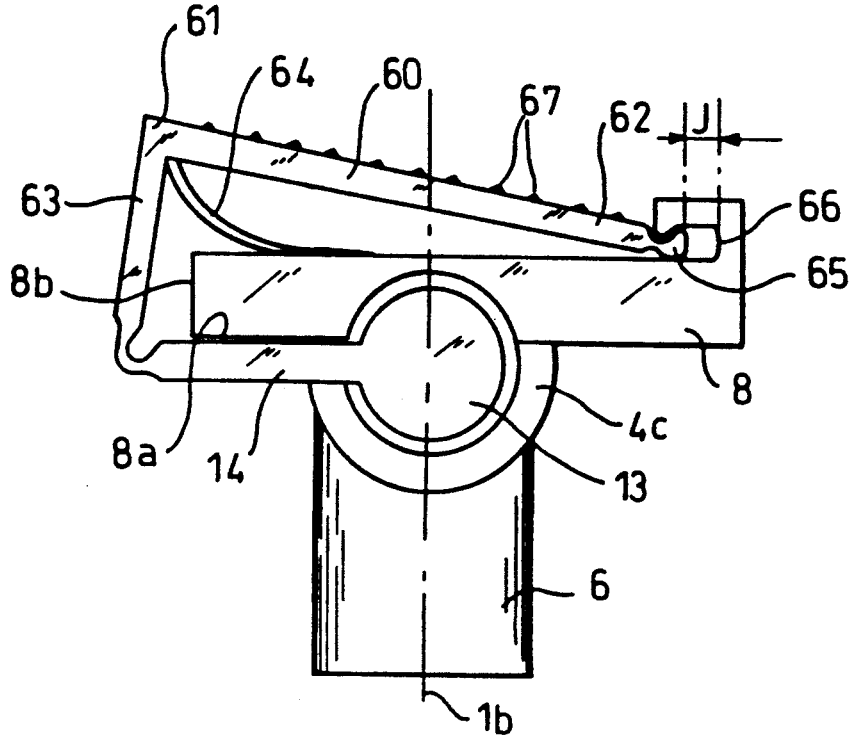
FIG. 8 is a view similar to FIG. 2*a* but showing another embodiment of the invention.
Figure 9:
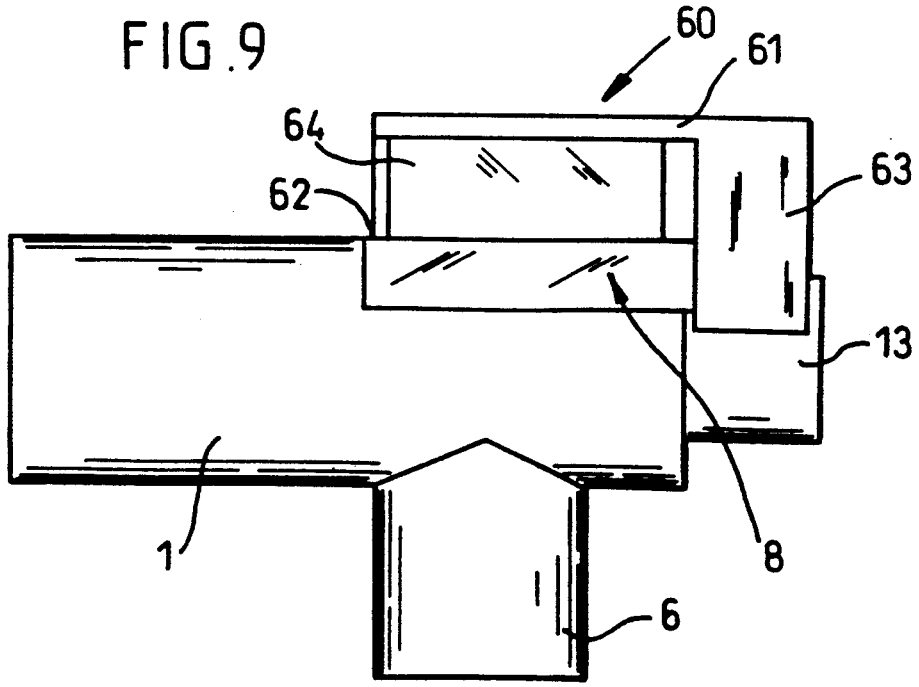
FIG. 9 is a side view of the FIG. 8 pushbutton.

FIGS. 8 and 9

FIGS. 8 and 9 show another embodiment of the pushbutton of the invention in which the adjustment member is used only to close the outlet orifice 3. The body 1 of the pushbutton and the adjustment member 10 may be similar in shape to the body 1 and the adjustment member 10 of FIGS. 1 to 3, except that in this case the drive rod 13 of the adjustment member has only one lug 14 or drive lever. The body 1 also differs from that shown in FIGS. 1 to 3 in that its thrust member 8 is asymmetrical about a vertical plane 1*b* containing the axis 1*a*.

As shown in FIGS. 8 and 9, the thrust member 8 includes a housing 66 at one of its side extremities, which housing is in the form of a slot extending parallel to the axis 1*a*.

In addition, the pushbutton includes a thrust piece 60 in the form of a plane plate situated above the thrust member 8. The piece 60 extends laterally between a first extremity 61 and a second extremity 62. The second extremity 62 of the thrust piece 60 includes a bead 65 running parallel to the axis 1*a* and snapping into the housing 66 with a degree of lateral clearance j. The second extremity 62 is thus hinged on the thrust member 8. The thrust piece 60 may advantageously include ribs 67 on its top face to prevent the user's finger from sliding in operation.

The first extremity 61 of the thrust piece projects laterally beyond the lateral edge 8*b* of the thrust member 8 and it is extended downwards by a tongue 63 which is hinged to the free end of the lug 14. The tongue 63 is advantageously made of molded plastic and is integral with the thrust piece 60 and with the lug 14. The hinge between the tongue 63 and the lug 14 is then formed by a region of reduced thickness.

In addition, resilient return means are provided between the thrust member 8 and the thrust piece 60 to urge the first extremity 61 of the thrust piece 60 upwards. Advantageously, this resilient return means is a spring blade 64 of plastic integrally formed with the thrust piece 60. However, the blade 64 could be replaced by a metal spring.

Thus, when the pushbutton is at rest, the spring blade 64 urges the first extremity 61 of the thrust piece upwards and maintains the lug 14 in abutment against the bottom surface 8*a* of the thrust member 8. In this rest position, the shutter 19 is disposed in such a manner as to close the outlet orifice 3.

When a user presses on the thrust piece 60, the first extremity 61 of the thrust piece begins by moving downwards, thereby rotating the adjustment member 10 about its axis 1*a* via the linkage constituted by the tongue 63 and the lug 14. During this movement, the rotation of the adjustment member 10 opens the outlet orifice 3 of the pushbutton When the first extremity 61 of the thrust piece 60 comes into abutment against the thrust member 8, the thrust exerted by the user is transmitted fully to the outlet tube 7' of the pump or valve on which the pushbutton is mounted, such that the pump or valve is actuated.

When the pushbutton is released, the spring blade 64 returns the thrust piece 60 upwards to its initial position It may be observed that during this movement, the clearance j of the hinge at the second extremity of the thrust piece makes it possible to avoid folding the tongue 63 where it joins the first extremity 61 of the thrust piece. In a variant, the clearance j could be omitted, providing a hinge is formed between the tongue 63 and the first extremity 61 of the thrust piece 60.

We claim:

1. A pushbutton for actuating a spray or dispenser device for spraying or dispensing a fluid substance, said device having an outlet tube, said pushbutton being capable of fitting onto the outlet tube of said spray or dispenser device and including an outlet orifice (3) for the substance, the pushbutton comprising:

a hollow body (1) adapted to communicate with said outlet tube via an inlet orifice (7; 30), said hollow body having a side wall whose inside shape has an axis of revolution, said hollow body having an outlet end (2) in which the outlet orifice is formed, said outlet end including an inside surface (2*a*) which does not lie in a plane perpendicular to said axis;

an adjustment member (10) rotatably received in the body of the pushbutton, the adjustment member including a shutter (19) having a front surface (19*a*) complementary to the inside surface of the outlet end when the shutter is in a closed position, the front surface of the shutter being disposed facing said inside surface of the outlet end and urged thereagainst by resilient means (18), said shutter defining axially parallel passage means (19*f*) for establishing communication between the inside surface of the outlet end and the inlet orifice, said passage means being radially offset from the outlet orifice; and drive means for rotating the adjustment member and the shutter to attendantly cause a volume between the inside surface of the outlet end and the complementary front surface of the shutter to vary, thereby enabling the outlet flow rate from the pushbutton to be varied.

2. A pushbutton according to claim 1, in which, in one rotational position, the front surface of the shutter bears in a sealed manner against the inside surface of the outlet end of the body such that the outlet orifice is fully closed.

3. A pushbutton according to claim 1, in which said adjustment member includes a portion which is held axially within said body, said resilient means being mounted between the shutter and said portion of said adjustment member that is held axially within said body.

4. A pushbutton according to claim 3, in which said resilient means is a resilient flexible tongue integrally formed with the shutter and said portion of said adjustment member that is held axially within said body.

5. A pushbutton according to claim 3, in which said portion of said adjustment member that is held axially within said body is extended towards the outside of the body of the pushbutton by the drive means, said drive means comprising a drive rod (13) provided with grip means (14) to enable said rod to be rotated.

6. A pushbutton according to claim 5, in which said grip means is constituted by at least one lug extending from the drive rod of the adjustment member.

7. A pushbutton according to claim 5, in which the body of the pushbutton includes abutment means limiting the rotation of the grip means and defining two abutment positions for said grip means corresponding respectively to an open angular position and to a closed angular position of the adjustment member.

8. A pushbutton according to claim 7, in which said abutment means is a portion of a thrust member enabling the pushbutton to be actuated.

9. A pushbutton according to claim 1, in which the inside surface of the outlet end of the body is a planar face.

10. A pushbutton according to claim 1, in which the front surface of the shutter defines a conical portion adapted to bear in a sealed manner with the inside surface of the outlet end of the body of the pushbutton.

11. A pushbutton according to claim 2, in which a volume of substance exposed to air when said pushbutton is in a closed position corresponds to an inside volume of the outlet orifice.

12. A pushbutton according to claim 1, in which the adjustment member is held angularly in position about the axis of revolution by a snug, frictional fit against the body.

13. A pushbutton according to claim 2, further including:

a thrust piece (60) overlying the body of the pushbutton and presenting at least one moving portion (61) that moves substantially parallel to the outlet tube of the spray or dispenser device;

mechanical link means (63) linking said moving portion of the thrust piece and said drive means for driving the adjustment member, enabling said drive means to be moved during displacement of said thrust piece;

resilient return means (64) for the thrust piece urging said thrust piece so as to move its moving portion away from the body of the pushbutton; and abutment means (8*a*) limiting the displacement of the moving portion of the thrust piece in a thrust direction of the resilient return means of the thrust piece, said abutment means thus defining a rest position for the thrust piece and for the adjustment member, in which position the shutter closes the outlet orifice.

14. A pushbutton according to claim 13, in which:

the drive means of the adjustment member include a drive lever projecting beyond the body;

the link means are constituted by a tongue hinged to said drive lever and linked to the moving portion of the thrust piece; and the moving portion of the thrust piece constitutes a first lateral extremity of said thrust piece, and said thrust piece includes an opposite second lateral extremity (62) of its moving portion, said second lateral extremity being hinged on the body.

15. A pushbutton according to claim 14, in which a hinge of said second lateral extremity of the thrust piece on the body provides said second lateral extremity with a degree of clearance (J) enabling it to move towards the first lateral extremity and also in the opposite direction.

16. A pushbutton according to claim 14, in which said second lateral extremity of the thrust piece includes a bead (65) snapped into a housing (66) of the body.

17. A pushbutton according to claim 14, in which said tongue is made of plastic integrally with the drive lever and the thrust piece.

18. A pushbutton according to claim 14, in which the thrust piece is made of plastic and the resilient return means of the thrust piece is constituted by a blade of plastic formed integrally with the thrust piece.

19. A pushbutton according to claim 14, in which said tongue is connected to the thrust piece via a hinge.

* * * * *